US006612405B2

(12) United States Patent
Zappa

(10) Patent No.: US 6,612,405 B2
(45) **Date of Patent: *Sep. 2, 2003**

(54) FRONTAL STRUCTURE FOR ELEVATOR CABINS

(75) Inventor: Roberto Zappa, Bergamo (IT)

(73) Assignee: Sematic Italia S.p.A., Bergamo (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/511,973

(22) Filed: Feb. 24, 2000

(65) Prior Publication Data

US 2002/0003066 A1 Jan. 10, 2002

(30) Foreign Application Priority Data

Oct. 12, 1999 (IT) ..... MI990620 U

(51) Int. Cl.[7] ..... B65B 11/02
(52) U.S. Cl. ..... 187/401
(58) Field of Search ..... 187/313, 401, 187/414, 400; 52/30, 204.1, 210, 213, 36.1, 637; 49/116, 120, 504

(56) References Cited

U.S. PATENT DOCUMENTS

| | | | | | |
|---|---|---|---|---|---|
| 3,740,907 | A | * | 6/1973 | Loomis | 52/30 |
| 4,514,946 | A | * | 5/1985 | Sherwood et al. | 52/211 |
| 4,700,809 | A | * | 10/1987 | Lazar | 187/401 |
| 4,875,552 | A | * | 10/1989 | Smith et al. | 187/401 |
| 5,394,961 | A | * | 3/1995 | Biver | 187/317 |
| 5,445,244 | A | * | 8/1995 | Ketonen | 187/414 |
| 5,505,280 | A | * | 4/1996 | Salmon et al. | 187/330 |
| 5,564,529 | A | * | 10/1996 | Ericson et al. | 187/401 |
| 5,609,224 | A | * | 3/1997 | Baggot | 187/313 |
| 5,794,746 | A | * | 8/1998 | Ketonen et al. | 187/333 |
| 5,887,681 | A | * | 3/1999 | Bondavalli | 187/333 |
| 5,975,249 | A | * | 11/1999 | Tomaseti | 187/401 |
| 6,082,501 | A | * | 7/2000 | Lehmann | 187/401 |

FOREIGN PATENT DOCUMENTS

| | | | | |
|---|---|---|---|---|
| JP | 401236190 | * | 9/1989 | 187/401 |
| JP | 403120183 | * | 5/1991 | 187/401 |
| JP | 405246658 | * | 9/1993 | 187/401 |
| JP | 405338974 | * | 12/1993 | 187/401 |

* cited by examiner

*Primary Examiner*—Christopher P. Ellis
*Assistant Examiner*—Paul T. Chin
(74) *Attorney, Agent, or Firm*—Bucknam & Archer

(57) ABSTRACT

A frontal structure for cabins of elevators, made of steel and/or aluminum or other suitable material, includes a pair of parallel uprights (18) (20), extending in the vertical direction and connected at the upper end by a plate (22) which forms the support for the movement mechanism or "operator" of the doors of the elevator.

2 Claims, 2 Drawing Sheets

FRONTAL STRUCTURE FOR ELEVATOR CABINS

FIELD OF THE INVENTION

Figure 1:
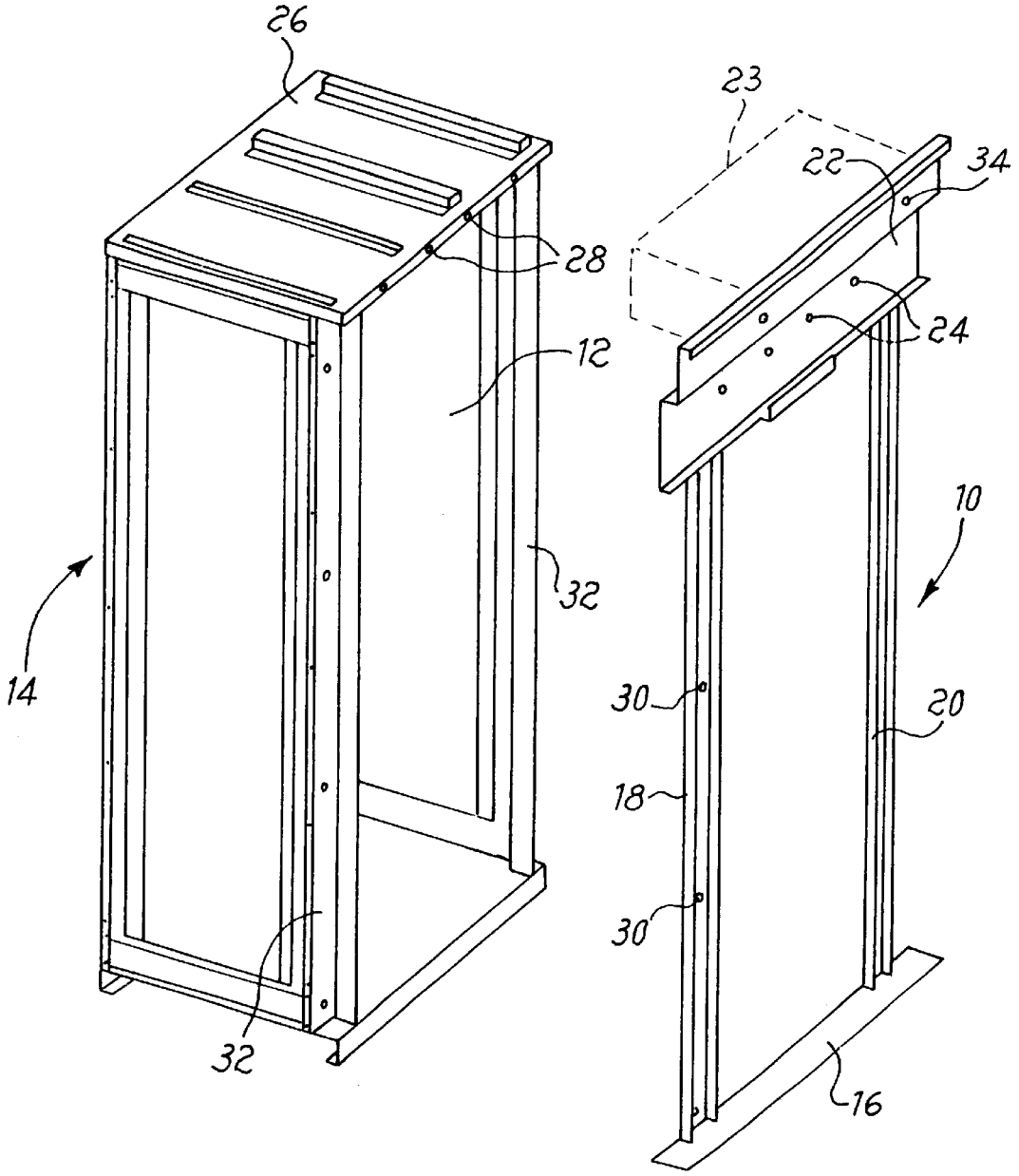

The present invention relates to a frontal structure for elevator cabins and more particularly to a frontal structure for elevators which is placed in an autonomous manner with respect to the elevator cabin and includes the mechanism for the movement of the complex, commonly called operators.

BACKGROUND OF THE PRIOR ART

It is known that elevators used for the transport of people are conventionally formed of a cabin for receiving the people, the cabin being moved and guided along an opening or a column in brickwork formed in the immobile structure and that two or more doors are associated with the cabin with two or more shutters, the doors being opened and closed according to the several levels or floors by means of a mechanism called an "operator." The "operator" traditionally is disposed and connected with the structure which forms the roof of the cabin of the elevator. The cabin is provided with a panel of anterior shielding or a housing which covers the complex of the fixed and movable devices which constitute the "operator" mechanism.

This known solution on one hand is effective with respect to the movements to be carried out but it is also accompanied by several drawbacks. In fact, the installation of the "operator" on the roof of the cabin of the elevator requires complex intervention which in general is carried out by means of metallic brackets which must be dimensioned and adjusted for each installation. In particular, the adjustments must be carried out with respect to the width, the height and the depth of the "operator" mechanism with respect to the existing structure, a fact that requires long and laborious operations to be carried out by qualified personnel. After installation, this mechanism must be protected by the above-mentioned housing after the suitable functional verifications are made, so that the overall installation becomes very laborious.

SUMMARY OF THE INVENTION

The object of the present invention is to overcome the drawbacks mentioned hereinabove. More particularly, the object of the present invention is to provide a frontal structure for elevator cabins which permits the optimization of the installation of the elevator by excluding the necessity for the several adjustments and functional verifications required for the mounting of the "operator".

Another object of the invention is to provide a structure as defined hereinabove which does not require further implementation for the protection of the "operator" mechanism after it combined with the elevator cabin.

Still another object of the invention is to provide for the people who are using the elevators a frontal structure for the cabins which guarantees a high level of resistance and reliability while simultaneously providing such a structure which may be easily and economically made.

This object, and still others are achieved by means of the frontal structure for the cabins for elevators according to the present invention, the structure being made of steel and/or aluminum or other suitable material, the structure being characterized essentially by the fact that it comprises a pair of vertically extending parallel uprights connected at the upper extremity by a body in the form of a plate which forms the support for the "operator" mechanism for the doors of the elevator.

BREIF DESCRIPTION OF THE DRAWINGS

The constructive and functional characteristics of the frontal structure for cabins of elevators of the present invention will be better understood by reference to the following description in which reference is made to the drawings which illustrate a preferred form of execution and are not intended to limit the invention.

FIG. 1. is a schematic front perspective view of the elevator cabin and the frontal structure of the elevator cabin.

Figure 2:
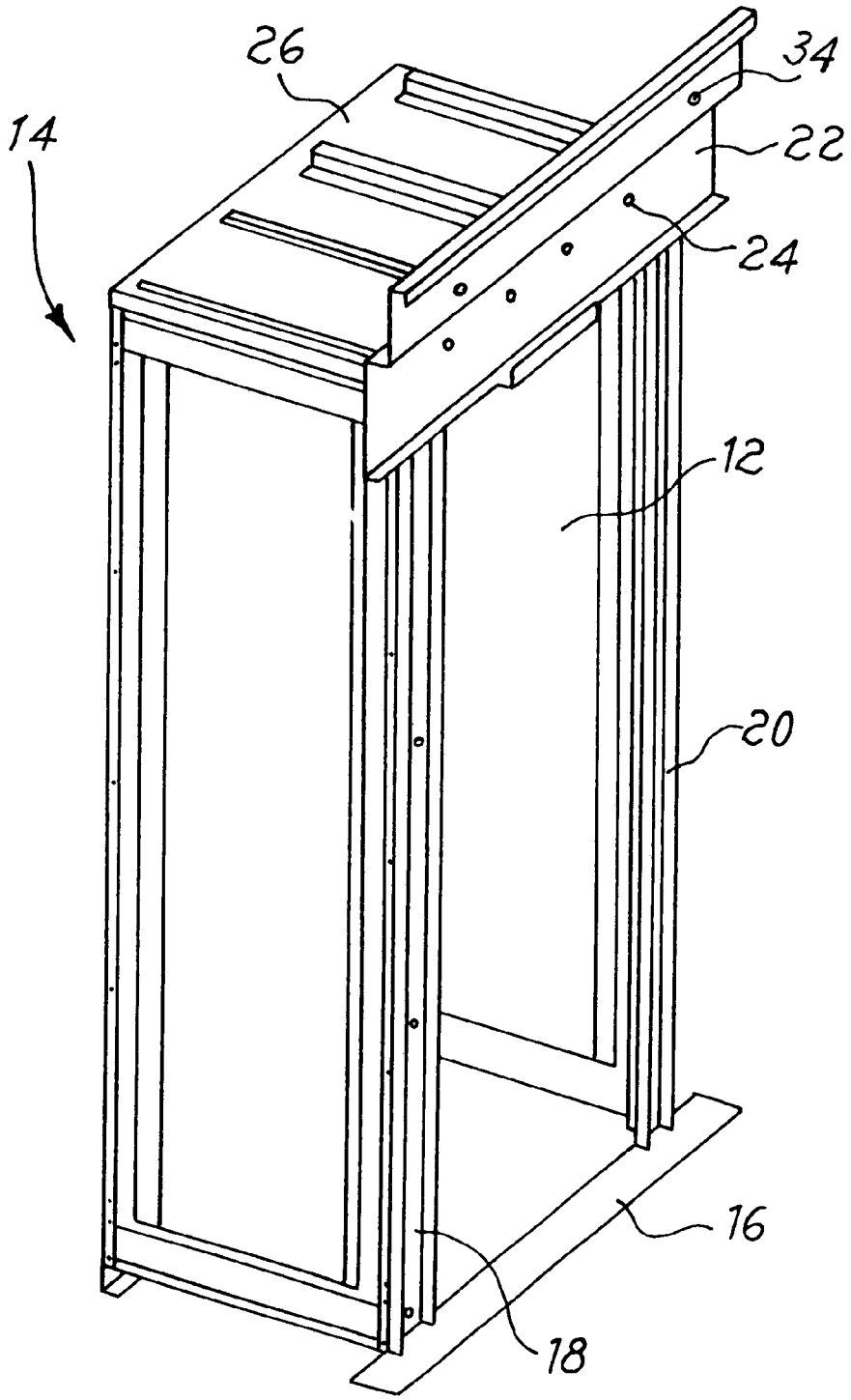

FIG. 2. is a schematic front perspective view of the elevator cabin and the frontal structure connected thereto.

DESCRIPTION OF THE PREFERRED EMBODIMENT

Referring to the drawings, the frontal structure for the elevator cabin according to the present invention indicated by numeral (10) in FIG. 1, is constituted by a metallic frame of rectangular shape and substantially complementary to the structure of the perimeter of the frontal opening (12) of an elevator cabin (14). This frame comprises a lower threshold (16), two shoulders or lateral uprights (18) and (20) and an upper plate (22) formed parallel to the threshold (16) and preferably protruding a small distance on the sides with respect to the upper end of the shoulders or uprights (18) and (20).

The threshold (16) and the plate (22) are made integral with the shoulders or uprights (18, 20) by well known means for instance, bolt and/or welding with eventual use of coupling squared structures. Several materials may be used to manufacture the threshold (16), the shoulders or uprights (18, 20) and the upper plate (22), for instance aluminum and steel. The shoulders are preferably constructed of "U" profiles and may be provided with stiffeners arranged in the longitudinal or another suitable direction. The upper plate (22), the configuration of which as shown in the drawings is a profile by way of example, constitutes the shielding element or housing for the movement or "operator" mechanism (23), shown in phantom in FIG. 1, and at the same time forms the support for the mechanism. The plate (22) is provided with holes and/or openings (34) suitably dimensioned to receive means for securing the mechanism by means of conventional bolts or equivalent means. Plate (22) has further holes (24) aligned to the frontal border of the roof (26) of the elevator cabin (14) which is provided with holes (28) to secure plate (22) thereto with screws or bolts. In the same manner, the shoulders or uprights (18) and (20) are provided with holes (30) which are suitably aligned with respect to holes formed along the exposed anterior front of uprights (32) which vertically limit the opening (12) of the cabin (14) so as to secure uprights (18) and (20) thereto. The cabin (14) installed in the opening or the column of the immobile structure and provided with doors (not shown) is made operative in a very easy and quick manner, placed as a complete structure, excluding the conventional electrical connections, it requires only the binding of the frontal structure of the present invention to the uprights (32) and the roof (26) of the cabin (14). In fact, this structure is already provided with the operator and related shielding or housing (22) which have been preassembled and suitably adjusted with respect to position. The task of the individual who installs the structure is limited to an operation which is simple and quick, obviously with savings in time and cost. In addition, in view of the fact that the mounting of the "operator" is carried out upstream, that is generally in the production facility in which there is ample availability of utensils and instruments, the risk of instability or loss of alignment of the several structures preassembled prior to installation does not occur.

It is clear from the foregoing that the present invention provides several advantages. The frontal structure for the elevator cabins of the present invention make the overall mounting very easy and accurate, may be achieved quickly and avoids the risks of subsequent adjustments.

The invention, as described hereinabove and in the claims has been described by way of an example and is not limiting, because modification and variation may be carried out which will fall within the novel concept.

What is claimed is:

1. A preassembled frontal structure (10) formed of steel or aluminum for an elevator cabin adapted to be connected directly to the elevator cabin at a frontal opening thereof and having a shape complementary to said frontal opening, said structure comprising a) a threshold portion (16) which forms a threshold of said elevator cabin;

b) a pair of vertically extending, spaced apart, parallel uprights (18) (20) connected at lower ends thereof to said threshold portion (16) and having first connection holes (30) therein for receiving connection means for connecting said parallel uprights to a pair of uprights which vertically limit the frontal opening of the elevator cabin;

c) a plate (22) connected to said parallel uprights (18) (20) at upper end thereof and having connecting holes (24) therein for receiving connection means for connecting said plate (22) to a frontal border of a roof of said elevator cabin and second connecting holes (34); and d) a door movement mechanism (23) secured to the internal front of said plate (22) at said second connecting holes (34), said plate (22) constituting the support and the frontal shielding for said door movement mechanism.

2. The preassembled frontal structure for an elevator cabin as defined in claim 1, wherein said parallel uprights (18) (20) are comprised of profiles having a "U" section.

* * * * *